US005635656A

United States Patent [19]

Bowden

[11] Patent Number: 5,635,656

[45] Date of Patent: Jun. 3, 1997

[54] HARMONICA JACK

[76] Inventor: Jack B. Bowden, 8006 Masonboro Sound Rd., Wilmington, N.C. 28409

[21] Appl. No.: 349,305

[22] Filed: Dec. 5, 1994

[51] Int. Cl.[6] ..... G10D 7/12

[52] U.S. Cl. ..... 84/379; 84/DIG. 14

[58] Field of Search ..... 84/723, 743, 327, 84/377–379, 402, 410, DIG. 14, DIG. 21

[56] References Cited

U.S. PATENT DOCUMENTS

| | | | |
|---|---|---|---|
| 1,884,150 | 10/1932 | Numberg | 84/379 |
| 3,612,741 | 10/1971 | Marshall | 84/DIG. 21 |
| 4,287,803 | 9/1981 | Zema | 84/379 X |
| 4,589,322 | 5/1986 | Finkenbeiner | 84/402 |
| 4,713,999 | 12/1987 | Burt | 84/379 |
| 5,479,841 | 1/1996 | Garrett | 84/379 |

*Primary Examiner*—Stanley J. Witkowski

[57] ABSTRACT

A harmonica holder that has multiple sides, with clips that hold a harmonica securely to each side of the holder, so that a musician may play a harmonica without use of his hands. The musician can quickly change harmonicas by rotating the harmonica holder by hand or by use of a motor that can be operated by a footswitch. The harmonica holder has a microphone inside, for amplifying the sound of the harmonica being played, this microphone is controlled by a volume control/on-off switch. Sympathetically vibrating strings assist in the resonance of the harmonicas, these strings are secured inside the harmonica holder, and can be adjusted from the outside of the harmonica holder with a friction tuning peg. The harmonica holder has a standard bracket that enables it to be mounted on a standard microphone stand.

10 Claims, 2 Drawing Sheets

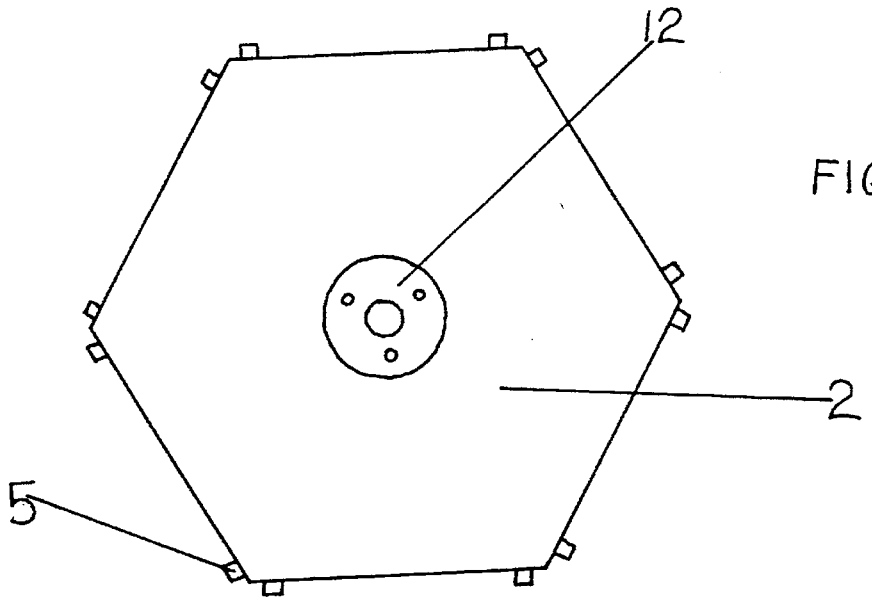
FIG. 3
FIG. 4
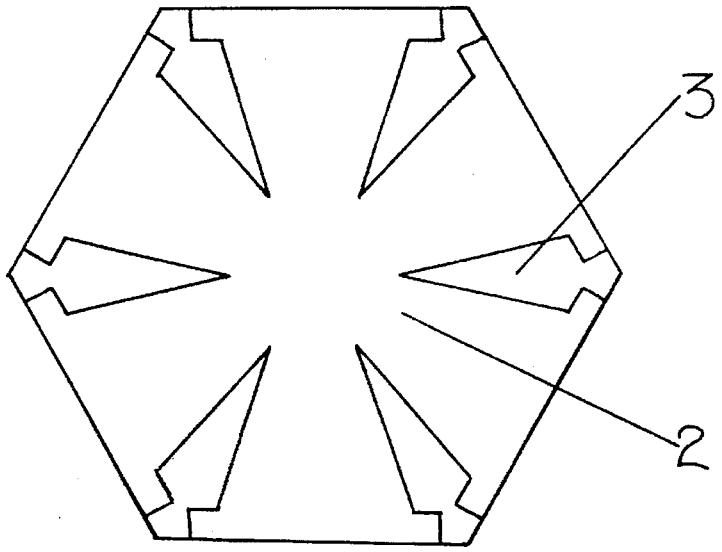

HARMONICA JACK

BACKGROUND OF THE INVENTION

1. Field of the Invention

The present invention relates generally to harmonica holders. More specifically, the present invention relates to a harmonica holder that can hold a plurality of harmonicas.

2. Description of Prior Art

Musicians have been known to use a device for holding a harmonica in order that the harmonica may be played without the use of hands, thus enabling a musician to play the harmonica and another instrument simultaneously.

Many useful harmonica holders already exist. One type of harmonica holder is worn by the musician such as the Jim Dunlop "HARP HANDLE," while other harmonica holders mount on a stand or to a microphone, such as the "HARMONICA STAND," of Hubbard, U.S. Pat. No. 4,212,219 and the "HARMONICA HOLDER AND SHROUD," of Hubbard, U.S. Pat. No. 4,397,213. Another existing patent is the "HARMONICA TO MICROPHONE ATTACHMENT DEVICE," of Miner, U.S. Pat. No. 4,541,321.

All of these harmonica holders are useful and allow a musician to play the harmonica while playing another instrument. Some of them also provide a successful means of amplifying the harmonica. However, most professional harmonica players use more than one harmonica during the course of a performance, and none of the foregoing harmonica holders can hold more than one harmonica at a time. Removing one harmonica from the harmonica holder and replacing it with another harmonica can be inconvenient and distracting during a performance. Hence there remains a need for a harmonica holder that can hold more than one harmonica, enabling the musician to change from one harmonica to another quickly and easily.

SUMMARY OF THE INVENTION

The principle object of the present invention is to provide a harmonica holder that can hold more than one harmonica, thus making it less difficult to change from one harmonica to another during a performance.

It is also an object of this invention to provide a harmonica holder of the foregoing character that can be mounted on to a conventional microphone stand.

Yet another object of this invention is to provide a harmonica holder of the foregoing character that is relatively inexpensive, thereby encouraging harmonica players to make use of my invention.

Briefly, a harmonica holder built in accordance with my invention employs a body, and clamping devices attached to the body in such a way that allows more than one harmonica to be held securely to the body. In the preferred embodiment of the invention, the geometric shape of the body is a hexagon although other geometric shapes may also be desirable.

The clamping devices are resilient clips arranged in pairs around the peripheral edges of the body. Also in the preferred embodiment of this invention, the body is hollow, allowing for added resonance. Also in the preferred embodiment of this invention there is a bracket for attaching the holder to a support stand. When changing from one harmonica to another, the musician simply rotates the microphone stand, so that the desired harmonica faces the musician.

These and other objects of the present invention will become apparent to those skilled in the art upon consideration of the following detailed description taken in conjunction with the drawings.

BRIEF DESCRIPTION OF THE DRAWINGS

FIG. 3 is a view of the underside of the harmonica holder.

FIG. 4 is a top view of the inside of the harmonica holder, illustrating the electronic components.

DESCRIPTION OF THE PREFERRED EMBODIMENT

Figure 1:
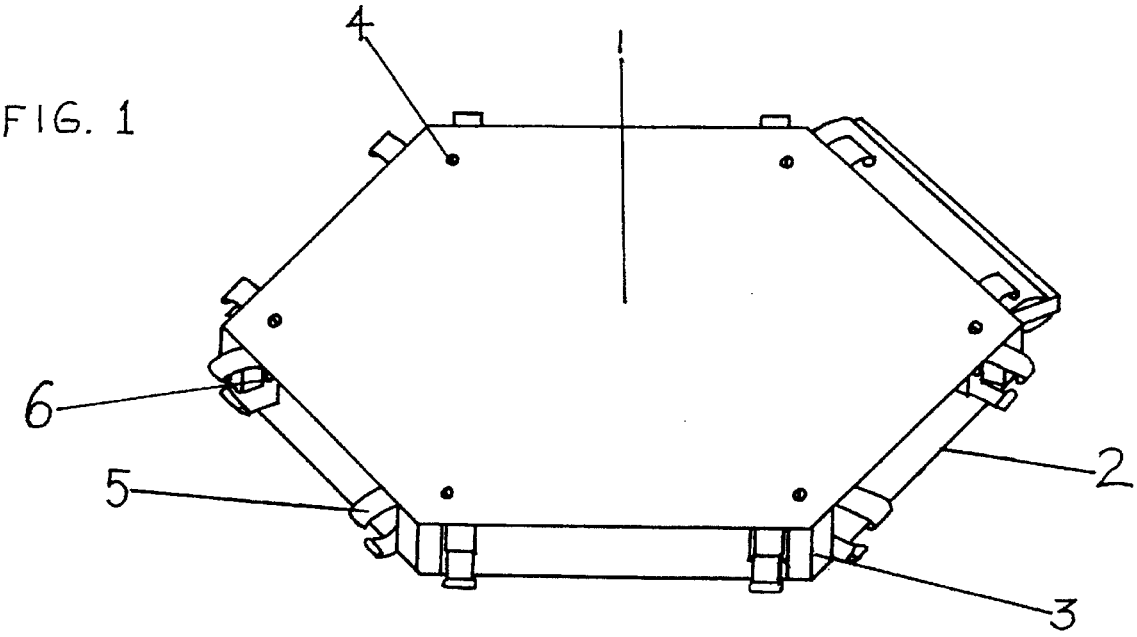
FIG. 1 is a perspective view of a multiple harmonica holder in accordance with my invention.
Figure 2:
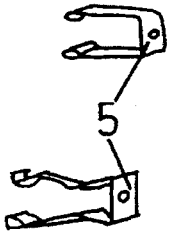
FIG. 2 is a detailed view of the resilient clips that fasten the harmonicas to the body of the harmonica holder.

Describing the MULTIPLE HARMONICA HOLDER in sufficient detail to permit an understanding and appreciation of my invention, it will be pointed out that the body of the MULTIPLE HARMONICA HOLDER is comprised of a top piece 1, a bottom piece 2, and several corner pieces 3. The top and bottom pieces are polygons of equal dimensions. The corner pieces are attached to the bottom piece with glue, and to the top piece with removable screws 4. Two resilient clips 5 are attached to each corner piece with a screw 6, in such a way that allows a harmonica 7 to be clipped into place parallel to each side of the body, utilizing one clip from each corner piece bordering the side.

On the underside of the HARMONICA JACK there is a standard female-threaded bracket 12 that allows the device to easily mount upon a standard microphone stand.

A second embodiment of this invention comprises multiple sided upper and lower vertically aligned panels, with fasteners that hold the two panels together, allowing a harmonica to be mounted at each side, clamped between the two panels.

A third embodiment of this invention comprises a multiple-sided top, middle and bottom piece, and fasteners that hold the three pieces together. Harmonicas may be mounted between the top and middle pieces, with the bottom panel raised so that it is flush with the middle piece, or the bottom panel may be lowered to accept a second tier of harmonicas clamped between the middle and bottom panels. The diameter of the top panel is smaller than the diameter of the middle panel, so the harmonicas angle upward. The diameter of the lower panel is greater than the diameter of the middle panel, and the middle panel is thick enough to allow a comfortable distance between the two tiers of harmonicas. On the top surface of the middle and bottom panels there is a groove parallel to each side wherein the lower rear edge of each harmonica seats.

I claim:

1. A multiple harmonica holder comprising a multiple sided body, and means for supporting a plurality of harmonicas in a fixed position around the perimeter of the body so that the harmonicas are supported end to end in the same horizontal plane around a vertical axis, with the back of each harmonica facing inward toward the vertical axis and the front of each harmonica facing outward in a readily playable position.

2. A multiple harmonica holder as described in claim 1 in which said means for supporting the harmonicas are resilient clips arranged in pairs.

3. A multiple harmonica holder as described in claim 1 in which said means for supporting the harmonicas comprises pairs of opposed resilient bars adapted to engage a harmonica therebetween.

4. A multiple harmonica holder as described in claim 1 in which said body is hollow.

5. A multiple harmonica holder as described in claim 1 in which the body employs a top piece, a bottom piece, and several corner pieces that are attached between said top and bottom.

6. A multiple harmonica holder as described in claim 1 in which the resilient clips are attached to the corner pieces.

7. A multiple harmonica holder as described in claim 1 with a centrally located bracket attached to said body for receiving a support stand, for mounting the harmonica holder to the stand.

8. A holder for holding a plurality of harmonicas, as described in claim 1 in which the body is a multiple sided clamp, comprising upper and lower panels, the panels being horizontal parallel planes, each having at least two straight sides, the straight sides on the panels being vertically aligned to receive and mount harmonicas between them, and fasteners for securing the panels together to secure harmonicas between the panels.

9. A multiple harmonica holder as described in claim 8 in which the diameter of the upper panel is smaller than the diameter of the lower panel, creating an offset in the vertical alignment of the upper and lower panels, enabling the harmonicas to be mounted at an angle, with the front of each harmonica higher than the rear of the harmonica and the upper rear edge of each harmonica closer to the vertical axis than the lower rear edge of the harmonica is to the axis.

10. A multiple harmonica holder as described in claim 9 in which there are three or more panels, to hold two or more layers of multiple harmonicas, with the lower panel having the greatest diameter and each panel above the lower panel having an increasingly smaller diameter, allowing the harmonicas to be mounted at an angle, with the front of each harmonica higher than the rear of the harmonica and the upper rear edge of each harmonica closer to the vertical axis than the lower rear edge is to the axis, with each panel between the upper and lower panels having sound holes to allow the free flow of air between all of the panels.

* * * * *